US009056470B2

(12) United States Patent
Morrow et al.

(10) Patent No.: US 9,056,470 B2
(45) Date of Patent: Jun. 16, 2015

(54) FLEXIBLE CIRCUIT SEAL

(75) Inventors: Michael M. Morrow, Salem, OR (US); Jay Holavarri, Corvallis, OR (US); Daniel W. Petersen, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 758 days.

(21) Appl. No.: 12/935,023

(22) PCT Filed: May 15, 2008

(86) PCT No.: PCT/US2008/063619

§ 371 (c)(1),
(2), (4) Date: Sep. 28, 2010

(87) PCT Pub. No.: WO2009/139773

PCT Pub. Date: Nov. 19, 2009

(65) Prior Publication Data

US 2011/0025784 A1 Feb. 3, 2011

(51) Int. Cl.

| | |
|---|---|
| ***B41J 2/05*** | (2006.01) |
| ***B41J 2/16*** | (2006.01) |
| *B41J 2/14* | (2006.01) |

(52) U.S. Cl.

CPC ..... *B41J 2/1623* (2013.01); *B41J 2/1607* (2013.01); *B41J 2002/14362* (2013.01); *B41J 2/14024* (2013.01); *B41J 2/14201* (2013.01); *B41J 2/1601* (2013.01)

(58) Field of Classification Search

CPC ..... B41J 2/1623; B41J 2/14024; B41J 2002/14362

USPC ..... 347/54–59

See application file for complete search history.

(56) References Cited

U.S. PATENT DOCUMENTS

| | | | | |
|---|---|---|---|---|
| 4,109,818 | A | 8/1978 | Hascoe et al. | |
| 5,519,425 | A | 5/1996 | Dietl et al. | |
| 5,648,805 | A | 7/1997 | Keefe et al. | |
| 5,706,040 | A | 1/1998 | Reid et al. | |
| 5,736,998 | A * | 4/1998 | Caren et al. | 347/45 |
| 6,197,145 | B1 | 3/2001 | Todd et al. | |
| 6,210,522 | B1 | 4/2001 | Singh et al. | |
| 6,361,160 | B2 * | 3/2002 | Feinn et al. | 347/87 |
| 7,246,892 | B2 * | 7/2007 | Choi et al. | 347/86 |
| 7,753,489 | B2 * | 7/2010 | Imai et al. | 347/50 |
| 2001/0015744 | A1 | 8/2001 | Feinn et al. | |
| 2003/0007042 | A1 * | 1/2003 | Lu et al. | 347/86 |
| 2005/0036014 | A1 | 2/2005 | Choi | |

(Continued)

FOREIGN PATENT DOCUMENTS

| | | |
|---|---|---|
| EP | 0564102 A2 | 10/1993 |
| JP | 1995-164634 | 6/1995 |
| JP | 11042797 | 2/1999 |

(Continued)

OTHER PUBLICATIONS

ISA Search Report and Written Opinion.

(Continued)

*Primary Examiner* — Daniel Petkovsek

(57) ABSTRACT

Various embodiments and methods relating to an adhesive paste layer (34, 134) sandwiched between a flexible circuit (30) and a fluid delivery system (26) to form a seal at least partially about a print head (28) are disclosed.

25 Claims, 9 Drawing Sheets

(56) References Cited

U.S. PATENT DOCUMENTS

| | | | |
|---|---|---|---|
| 2007/0206067 | A1 | 9/2007 | Blackburn et al. |
| 2007/0212551 | A1 | 9/2007 | Collins |

FOREIGN PATENT DOCUMENTS

| | | |
|---|---|---|
| JP | 2000-343712 | 12/2000 |
| JP | 2002026471 | 1/2002 |
| JP | 2002-79675 | 3/2002 |
| JP | 2004284112 | 10/2004 |
| JP | 2006-289894 | 10/2006 |
| JP | 2006-341507 | 12/2006 |
| JP | 2007-55221 | 3/2007 |

OTHER PUBLICATIONS

Supplementary European Search Report for Application No. EP08755469.7. Report issued Aug. 20, 2013.

* cited by examiner

FLEXIBLE CIRCUIT SEAL

BACKGROUND

During print head priming, a vacuum is created to draw fluid through nozzles of the print head. Leaks to atmosphere may impair such priming. Fluid communication between adjacent print heads may also lead to cross-contamination.

DETAILED DESCRIPTION OF THE EXAMPLE EMBODIMENTS

Figure 1:
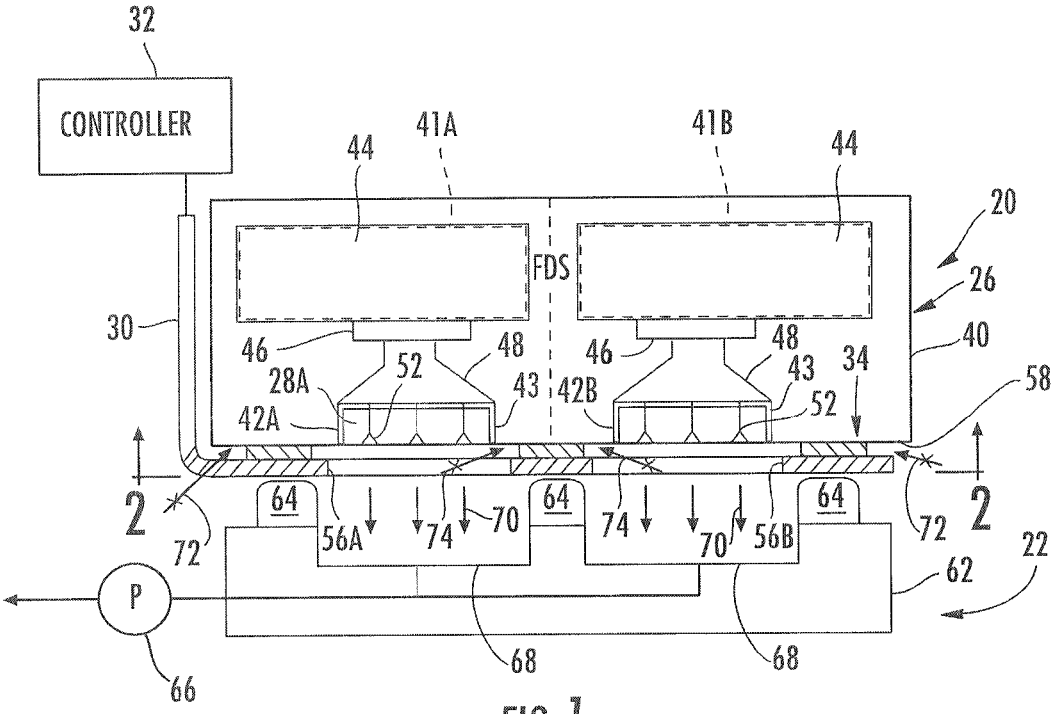
FIG. 1 is a sectional view of schematically illustrating priming of a printing device according to an example embodiment.
Figure 2:
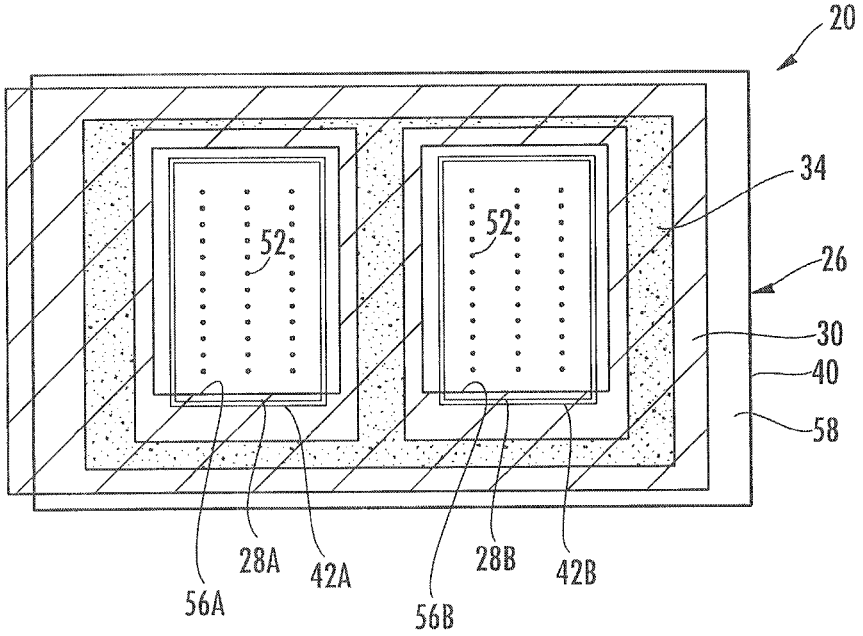
FIG. 2 is a sectional view of the printing device of FIG. 1 taken along line 2-2 according to an example embodiment.

FIGS. 1 and 2 schematically illustrate printing device 20 according to an example embodiment. FIG. 1 further illustrates priming device 22 priming and servicing printing device 20. As will be described hereafter, printing device 20 is configured to reduce leakage during priming to enhance effectiveness of priming and to reduce cross-contamination.

As shown by FIG. 1, printing device 20 includes fluid delivery system 26, print heads 28A, 28B (collectively referred to as print heads 28), flexible circuit 30, controller 32 and solidified adhesive paste layer 34. Fluid delivery system 26 comprises a mechanism configured to supply and deliver fluid, such as ink, to print heads 28. Fluid delivery system 26 includes a body 40, back pressure regulation mechanisms 44, filters 46 and standpipes 48. Body 40 comprises one or more structures configured to contain fluid. In one embodiment, body 40 may comprise a self-contained reservoir of fluid. In another embodiment, body 40 may receive fluid from a remote fluid supply or may circulate fluid to and across print heads 28.

In the embodiment illustrated, body 40 includes isolated internal chambers 41A and 41B (collectively referred to as chambers 41) for supplying distinct fluids to print heads 28A and 28B, respectively. For example, in one embodiment, a first color of ink may be supplied to print head 28A while a second distinct color of ink is applied to print head 28B. For purposes of this disclosure, with reference to inks, the term "color" includes black inks. In other embodiment, body 40 may include greater or fewer of such isolated chambers.

In the example illustrated in FIG. 1, body 40 includes pockets 42A and 42B (collectively referred to as pockets 42). Pockets 42 comprise recesses or cavities formed in a lower side of body 40 configured to receive print heads 28. Due to clearances between pockets 42 and print heads 28, pockets 42 form gaps or moats 43 between print heads 28 and body 40. Although body 40 is illustrated as including two such pockets, in other embodiments, body 40 may include a greater or fewer of such pockets 42.

Back pressure regulation mechanisms 44 (schematically shown) comprise mechanisms configured to provide a controlled extent of back pressure so as to reduce the likelihood of fluid drooling through print heads 28. Examples of back pressure regulation mechanisms 44 include, but are not limited to, inflatable bags, foam or other capillary members. Filters 46 extend between mechanisms 44 and standpipes 48 to filter fluid prior to entering standpipes 48. Standpipes 48 comprise fluid passages including one or more slots for directing fluid to print heads 28. In other embodiments, fluid delivery system 26 may include other mechanisms for delivering fluid to print heads 28 and may omit one or more of back pressure regulation mechanisms 44, filters 46 and standpipes 48.

Print heads 28 comprise mechanisms to selectively eject fluid, such as ink, onto a print medium in response to control signal received from controller 32. In one embodiment, print heads 28 may comprise thermoresistive drop-on-demand inkjet print heads. In another embodiment, print heads 28 may comprise piezo resistive drop-on-demand inkjet print heads. Print heads 28 each include a series or array of openings or nozzles 52 configured to receive fluid from fluid delivery system 26. In the example illustrated, nozzles 52 of print heads 28 are in fluid communication with standpipes 48.

In the particular example illustrated, print head 28A is in fluid communication with chamber 41A so as to selectively eject a first type of fluid. Print head 26B is in fluid communication with chamber 41B so as to selectively eject a second distinct type of fluid. In other embodiments, printing device 20 may include a greater or fewer of such print heads 28.

Flexible circuit 30 comprises a series or array of electrical circuits encased in a dielectric material, such as a polymeric encasement. In one embodiment, the polymeric encasement comprises one or more polyamides. Flexible circuit extends from controller 32 to print heads 28. As shown by FIG. 2, flexible circuit 30 includes openings 56A and 56B (collectively referred to as openings 56) such that flexible circuit 30 extends completely about or around pockets 42 and print heads 28 on all sides of print heads 28. Openings 56A and 56B are in substantial alignment with pocket 42A and with pocket 42B, as well as print head 28A and print head 28B, respectively.

As shown by FIG. 2, in the example illustrated, a portion of flexible circuit 30 slightly extends beneath or underlies a small portion of print heads 28, facilitating connection between flexible circuit 30 and print heads 28. Flexible circuit 30 bends and wraps about fluid delivery system 26, extends towards controller 32 and is coupled to or retained along a side of body 40 so as to not interfere with printing upon the print media. Flexible circuit 30 facilitates facilitate communication between print heads 28 and controller 32.

In other embodiments, flexible circuit 30 may have other configurations. For example, in other embodiments, flexible circuit 30 may openings 56 having different shapes and different relative locations. In other embodiments, flexible circuit 30 may merely include a single opening 56 or may include greater than two openings 56. In other embodiments, flexible circuit 30 may not extend completely about and on all sides of print heads 28.

Controller 32 comprises one or more processing units coupled to print heads 28 by flexible circuit 30. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 32 may be embodied as part of one or more application-specific integrated circuits (ASICs). Unless otherwise specifically noted, the controller is not limited to any specific combination of hardware circuitry and software, nor to any particular source for the instructions executed by the processing unit. Controller 32 generates control signals which are transmitted by flexible circuit 30 to print heads 28. The control signals cause print heads 28 to selectively eject fluid through selected nozzles 52 in a controlled fashion.

Solidified adhesive paste layer 34 comprises a layer or bead of solidified adhesive paste sandwiched between flexible circuit 30 and a lower surface or face 58 of body 40 at least partially about a perimeter of one or both of print heads 28. Solidified adhesive paste layer 34 has sufficiently low viscosity, prior to curing or solidification, such that the adhesive paste may flow into or wet gaps or voids in surface 58 as well as along the exterior of flexible circuit 30. In addition, layer 34 also accommodates surface irregularities or non-flatness associated with surface 58. As a result, upon curing or other solidification, the adhesive paste of layer 34 forms a hermetic seal between surface 58 and the opposing portion of flexible circuit 30. The seal formed by layer 34 between surface 58 of body 40 and flexible circuit 30 inhibits airflow or fluid flow between flexible circuit 30 and body 40. Consequently, priming is enhanced and cross-contamination of different fluids between print heads 28 is reduced.

In the example illustrated, the adhesive paste material of layer 34 has a sufficiently low viscosity so as to readily flow into the gaps or voids a long surface 58 and along flexible circuit 30. In one embodiment, the adhesive paste material has a viscosity at room temperature of less than or equal to about 200,000 centipoise (cp). In one embodiment, the adhesive paste material a layer 34 comprises an epoxy paste. In one embodiment, adhesive paste layer 34 comprises a 1 part epoxy paste (does not need mixing, but utilizes a curing process step). In one embodiment, adhesive paste layer 34 comprises Bisphenol A thermosetting epoxy. In other embodiments, other types of adhesive pastes may be used.

Adhesive paste layer 34 may be formed between flexible circuit 30 and surface 58 of body 40 in various manners. In one embodiment, adhesive paste material of layer 34 may be initially deposited upon flexible circuit 30, wherein flexible circuit 30 is then pressed against surface 58, bringing layer 34 into contact with surface 58. In another embodiment, adhesive paste material of layer 34 may be initially deposited upon surface 58, wherein flexible circuit 30 is pressed into contact with the adhesive paste material of layer 34 on surface 58.

The adhesive paste material of layer 34 may be applied on one or both of flexible circuit 30 and surface 58 by various techniques including, but not limited to, robot needle dispensing, showerhead dispensing, manual needle dispensing, silk screening, or patterned preforms. With patterned preforms, the adhesive paste material may be in a non-paste state upon both sides of the preform, wherein the preform is treated, such as with the application of heat, so as to cause the adhesive paste material on the preform or backing to change to a paste state. Once in the paste state, the adhesive paste material on the preform may be pressed into contact with either surface 58 or flexible circuit 30 prior to being joined to the other of surface 58 or flexible circuit 30.

As shown by FIG. 2, solidified adhesive paste layer 34 extends at least partially about a perimeter of each of print heads 28. In the example illustrated, layer 34 continuously extends about both of print heads 28, collectively, while being sandwiched between surface 58 and circuit 30. As a result, layer 34 forms a continuous seal between circuit 30 and surface 58 about both of print heads 28.

As further shown by FIG. 2, solidified adhesive paste layer 34 also continuously extends between print heads 28 while being sandwiched between surface 58 and circuit 30. Layer 34 also forms a continuous uninterrupted wall between print heads 28 to isolate print heads 28A and 28B from one another. As a result, layer 34 also inhibits the flow of fluid, such as ink, between circuit 30 and surface 58 from one of print heads 28 to another of print heads 28 to reduce or eliminate cross-contamination during priming.

FIG. 1 schematically illustrates priming using priming device 22. Priming device 22 includes cap 62, sealing members 64 and pump 66. Cap 62 comprises structure forming basins 68. Basins 68 provide volumes configured to be positioned opposite to print heads 28 so as to receive fluid drawn through nozzles 52 during priming of nozzles 52.

Sealing members 64 comprise structures configured to seal against printing device 20. In the example illustrated, sealing members 64 seal against an underside of flexible circuit 30 or seal against those portions of surface 58 not covered by circuit 30 to prevent fluid flow between members 64 and flexible circuit 30 or to prevent fluid flow between members 64 and surface 58 during priming. In one embodiment, sealing members 64 comprises elastomeric or compressible rings or gaskets of material configured to deform or compress when forming a seal against circuit 30 or portions of surface 58.

Pump 66 comprises a fluid pump include communication with basins 68. Pump 66 is configured to draw or pump air from basins 68 so as to create a vacuum in basins 68 against print heads 28. In one embodiment, pump 66 may comprise a peristaltic pump. In other embodiments, pump 66 may have other configurations.

As schematically represented by arrows 70, the vacuum created in basins 68 by pump 66 draws fluid through nozzles 52 of print heads 28 into basins 68 to prime print heads 68. The withdrawn fluid is subsequently removed from basins 68 by pump 66. As schematically represented by crossed out arrows 72, the vacuum created in basins 68 may also attempt to draw air between any gaps that may exist between flexible circuit 30 and surface 58 of body 40. However, solidified adhesive paste layer 34 fills any such avoids or irregularities and inhibits leakage of air into basins 68. As a result, priming performance is enhanced.

At the same time, as schematically represented by crossed out arrows 74, the vacuums created within basins 68 may also tend to draw ejected fluid between surface 58 and flexible circuit 30 between print heads 28. However, solidified adhesive paste layer 34 fills any voids or cavities that may exist between circuit 30 and surface 58 between print heads 28 to prevent such fluid flow. As a result, layer 34 reduces or prevents cross-contamination of different types of fluid, such as different colors of ink.

Figure 3:
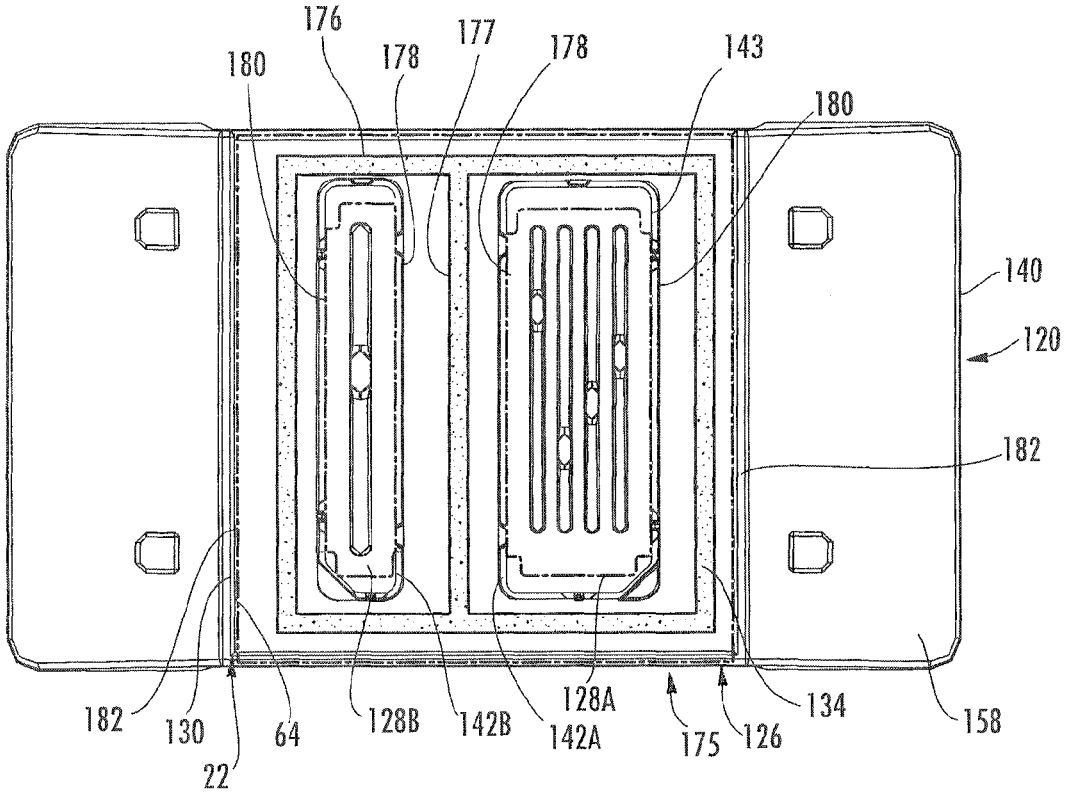
FIG. 3 is a bottom plan view of another embodiment of the printing device of FIG. 1 illustrating relative positioning of a sealing zone during priming according to an example embodiment.

FIG. 3 illustrates printing device 120, a particular embodiment of printing device 20, with portions omitted for purposes of illustration. As shown by FIG. 3, printing device 120 includes fluid delivery system 126, print heads 128A, 128B (collectively referred to as print heads 128), flexible circuit 130, controller 32 (shown in FIG. 1) and solidified adhesive paste layer 134. Fluid delivery system 126, print heads 128 and flexible circuit 130 are substantially identical to fluid delivery system 26, print heads 28 and flexible circuit 30 shown and described with respect to FIGS. 1 and 2. For purposes of illustration, print heads 128 are illustrated without an overlying nozzle plate to better illustrate pockets 142A and 142B receiving and extending about print heads 128A and 128B, respectively. In the particular example illustrated in FIG. 3, print heads 128A and 128B have slightly different configurations as compared to print heads 28A and 28B which are schematically shown in FIGS. 1 and 2.

As further shown by FIG. 3, solidified adhesive paste layer 134 comprises a layer or bead of solidified adhesive paste sandwiched between flexible circuit 130 and a lower surface or face 158 of body 140 about both of print heads 128. Solidified adhesive paste layer 34 has sufficiently low viscosity, prior to solidification, such that the adhesive paste may flow into or wet gaps or voids in surface 158 as well as along the exterior of flexible circuit 130. In addition, layer 134 also accommodates surface irregularities or non-flatness associated with surface 158. As a result, upon curing or other solidification, the adhesive paste of layer 134 forms a hermetic seal between surface 158 and the opposing portion of flexible circuit 130. In particular embodiments, the adhesive paste material of layer number 134 may only partially solidify, wherein the final layer 134 has a sufficiently high viscosity to maintain its integrity during priming. The seal formed by layer 134 between surface 158 of body 140 and flexible circuit 130 inhibits airflow or fluid flow between flexible circuit 130 and body 140. Consequently, priming is enhanced and cross-contamination of different fluids between print heads 128 is reduced.

In the example illustrated, the adhesive paste material of layer 134 has a sufficiently low viscosity so as to readily flow into the gaps or voids along surface 158 and along flexible circuit 130. In one embodiment, adhesive paste material has a viscosity at room temperature of less than or equal to about 200,000 centipoise (cp). In one embodiment, the adhesive paste material a layer 134 a 1 part epoxy paste (does not need mixing, but utilizes a curing process step). In one embodiment, adhesive paste layer 134 comprises Bisphenol A thermosetting epoxy. In other embodiments, other types of adhesive pastes may be used.

Adhesive paste layer 134 may be formed between flexible circuit 130 and surface 158 of body 140 in various manners. In one embodiment, adhesive paste material of layer 134 may be initially deposit upon flexible circuit 130, wherein flexible circuit 130 is then pressed against surface 158, bringing layer 134 into contact with surface 158. In another embodiment, adhesive paste material of layer 134 may be initially deposit upon surface 158, wherein flexible circuit 130 is pressed into contact with the adhesive paste material of layer 134 on surface 158.

The adhesive paste material of layer 134 may be applied on one or both of flexible circuit 130 and surface 158 by various techniques including, but not limited to, robot needle dispensing, showerhead dispensing, manual needle dispensing, silk screening, or patterned preforms. With patterned preforms, the adhesive paste material may be in a non-paste state upon the preforms, wherein the preform is treated, such as with the application of heat, so as to cause the adhesive paste material on both sides of the preform or backing to change to a paste state. Once in the paste state, the adhesive paste material on the preform may be pressed into contact with either surface 158 or flexible circuit 130 prior to being joined to the other of surface 58 or flexible circuit 30.

FIG. 3 illustrates one example pattern 175 for layer 134. With pattern 175, layer 134 continuously extends about both of print heads 128, collectively, while being sandwiched between surface 158 and circuit 130. As a result, layer 134 forms a continuous seal between circuit 130 and surface 158 about both of print heads 128.

With pattern 175, solidified adhesive paste layer '134 also continuously extends between print heads '128 while being sandwiched between surface '158 and circuit '130. Pattern 175 includes a loop 176 continuously extending about both print heads 128 and a segment 177 extending between printheads 128 and interconnecting opposite sides of look 176. Layer '134 forms a continuous wall between print heads 128 to isolate print heads 128A and 128B from one another. As a result, layer 134 also inhibits the flow of fluid, such as ink, between circuit 130 and surface 158 from one of print heads 128 to another of print heads 128 to reduce or eliminate cross-contamination during priming.

FIG. 3 further illustrates the position of priming device 22 (described above with respect to FIG. 1) with respect to printing device 120 during priming to form a sealing zone. In particular, FIG. 3 illustrates the relative positioning of sealing members 64 during priming. As shown by FIG. 3, solidified adhesive paste layer 134 is formed between flexible circuit 130 and surface 158 of body 140 such that layer 134 is centrally located midway or equidistantly between the inner edges 178 of pockets 142. Layer 134 is also located midway between or equidistantly between the outer edges 180 of such pockets 142 and outboard edges 182 of flexible circuit 130. Because layer 134 is located midway between such edges, adhesive layer 134 is less likely to squeeze out into moats 143 and into pockets 142 where such adhesive paste may become deposited excessively close to the dies of print heads 128 so as to potentially interfere with wiping and impose strains upon the print head dies. Moreover, those portions of flexible circuit 130 overlying layer 134 are directly opposite to the nominal location or extent of sealing members 64 of priming device 22. As a result, sealing members 64 may better seal against the portion of the flexible circuit 130 rigidified by layer 134.

In other embodiments, adhesive layer 134 may be positioned or formed at other locations relative to edges 178, 180 and 182. For example, in other embodiments, portions of layer 134 may alternatively be formed proximate to or even along edges 182 or more proximate to and along edges 180. That portion of layer 134 extending between print heads 128 may alternatively extend or proximate to or even adjacent to edge 178 of the print head 128A or edge 178 of print head 128B. Even with such alternative embodiments, reduced leakage and reduced cross-contamination may be achieved.

Figure 4:
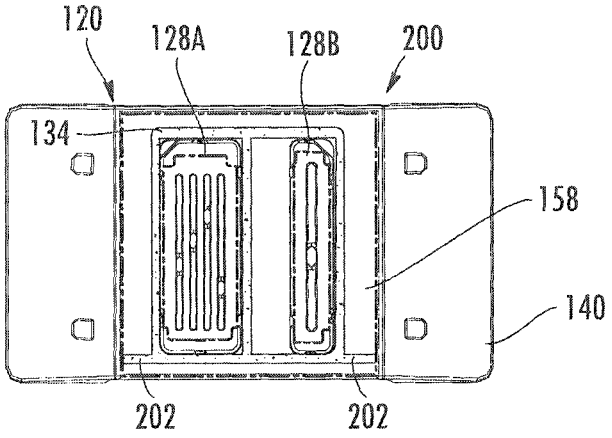
FIGS. 4-12 are bottom plan view the illustrating various patterns for a solidified adhesive paste layer of the printing device of FIG. 3 according to an example embodiment.

FIGS. 4-13 illustrate other alternative patterns for solidified adhesive paste layer 134. FIG. 4 illustrates pattern 200 for solidified adhesive paste layer 134. Pattern 200 is similar to pattern 175 except that pattern 180 extends closer to edge 178 of print head 128A and additionally includes segments 202. Segments 202 provide additional adhesive areas for securing flexible circuit 130 to body 140. As a result, flexible circuit 130 is more securely retained along body 140.

Figure 5:
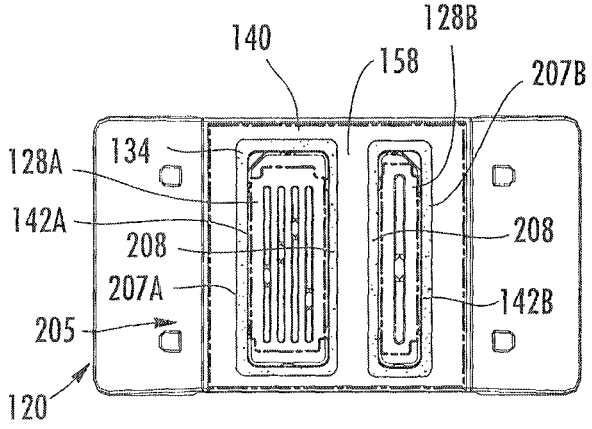

FIG. 5 illustrates pattern 205 for solidified adhesive paste layer 134. As shown by FIG. 5, with pattern 205, adhesive paste layer 134 comprises two continuous uninterrupted loops 207A, 207B continuously extending about an entire perimeter of each of print heads 128A and 128B, respectively. Although loops 207 are illustrated as being relatively close to print heads 128, in other embodiments, loops 207 may be more greatly spaced from edges of print heads 128 and their associated pockets 142. With pattern 205, two walls 208 are provided between print heads 128, adding isolation between print heads 128 to reduce cross-contamination.

Figure 6:
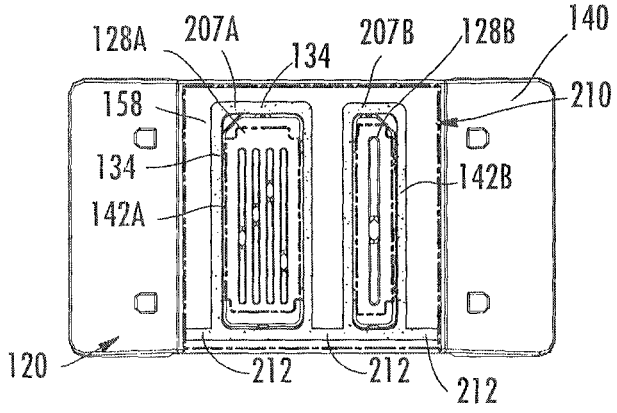

FIG. 6 illustrates pattern 210 of solidified adhesive paste layer 134. Pattern 210 is similar to pattern 205 except that pattern 210 additionally includes segments 212. Segments 212 provide enhanced securement of flexible circuit 130 (shown in FIG. 3) relative to surface 158.

Figure 7:
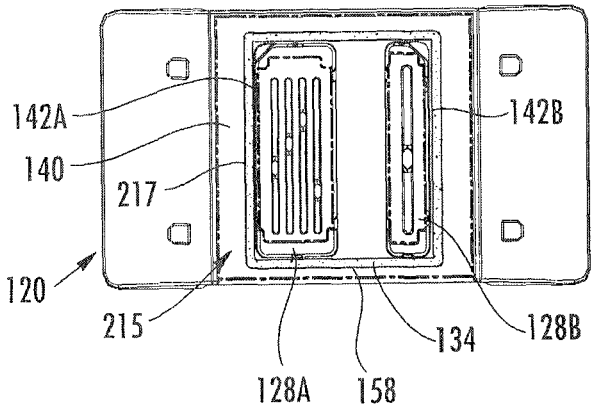

FIG. 7 illustrates pattern 215 of solidified adhesive paste layer 134. Pattern 215 is similar to pattern 175 except that pattern 215 comprises a single loop 217 extending continuously and entirely about both print heads 128 without extending between print heads 128. Pattern 215 provides a lesser degree of isolation between print heads 128, but may be easier to apply and may be beneficial in embodiments where print heads 128 are extremely close to one another.

Figure 8:
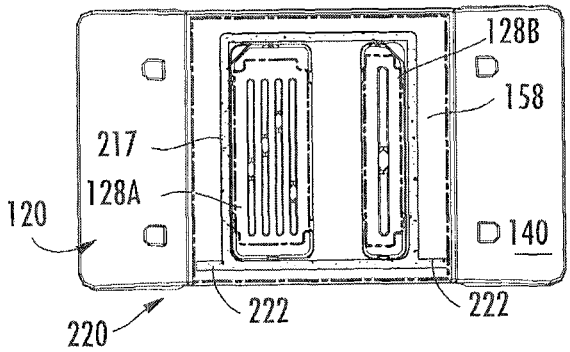

FIG. 8 illustrates pattern 220 of solidified adhesive paste layer 134. Pattern 220 is similar to pattern 215 except that pattern 220 additionally includes segments 222. Segments 222 provide enhanced securement of flexible circuit 130 (shown in FIG. 3) relative to surface 158.

Figure 9:
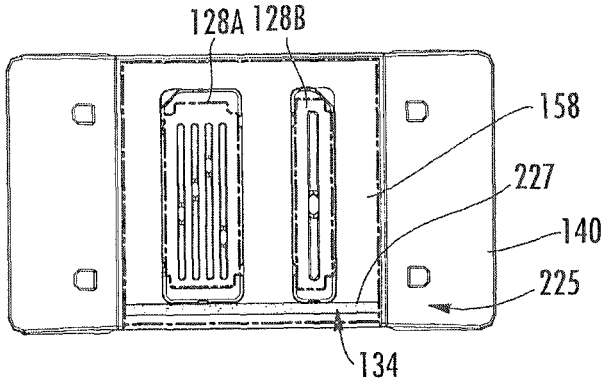
Figure 10:
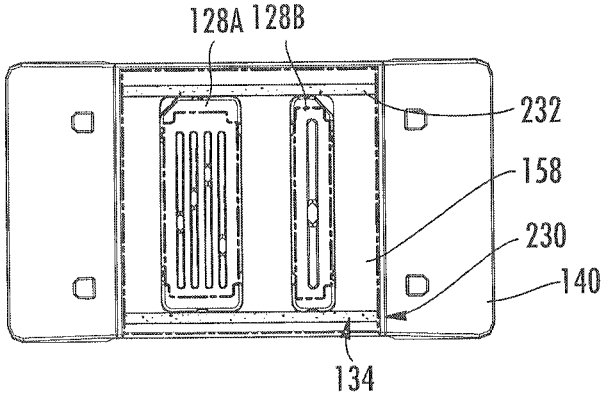

FIGS. 9-12 illustrate various other patterns of adhesive paste layer 134, wherein layer 134 does not completely surround one or both of print heads 128, but alternatively extends along one or more sides of print heads 128. FIG. 9 illustrates pattern 225 in which layer 134 comprises a single segment or line 227 extending across the shorter side of print heads 128. FIG. 10 illustrates pattern 230. Pattern 230 is similar to pattern 225 except that pattern 230 includes an additional line 232 on an opposite side of print heads 128. Patterns 225 and 230 may reduce leakage along particular sides of print heads 128 and may provide enhanced securement of flexible circuit 130 (shown in FIG. 3) as compared to a printing device 120 omitting layer 134.

Figure 11:
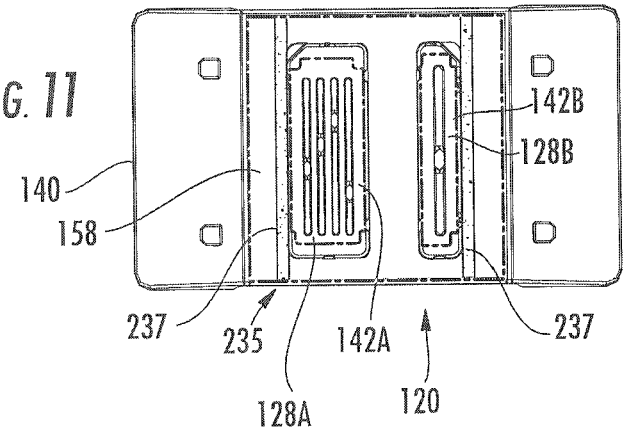

FIG. 11 illustrates pattern 235 of solidified adhesive paste layer 134. Pattern 235 includes a pair of opposing segments or lines 237 extending on the longer sides of print heads 128 along opposite side to apprentice 128. Lines 237 may reduce leakage along particular sides of print heads 128 and may provide enhanced securement of flexible circuit 130 (shown in FIG. 3) as compared to a printing device 120 omitting layer 134.

Figure 12:
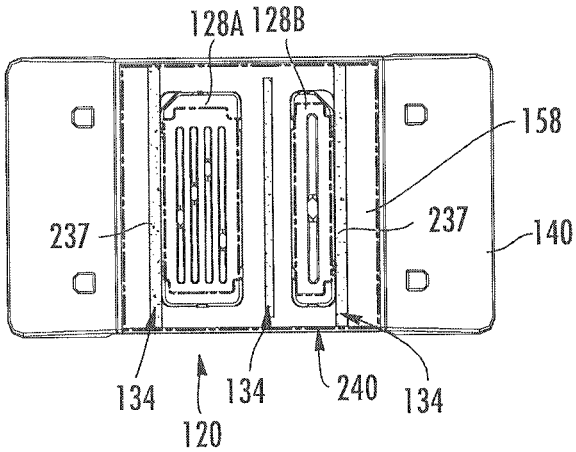

FIG. 12 illustrates pattern 240 of solidified adhesive paste layer 134. Pattern 240 is similar to pattern 235 except that pattern 240 additionally includes segment or line 242. Line 242 extends between print heads 128. Line 242 provides additional isolation between print heads 128 to reduce likelihood of cross contamination.

Figure 13:
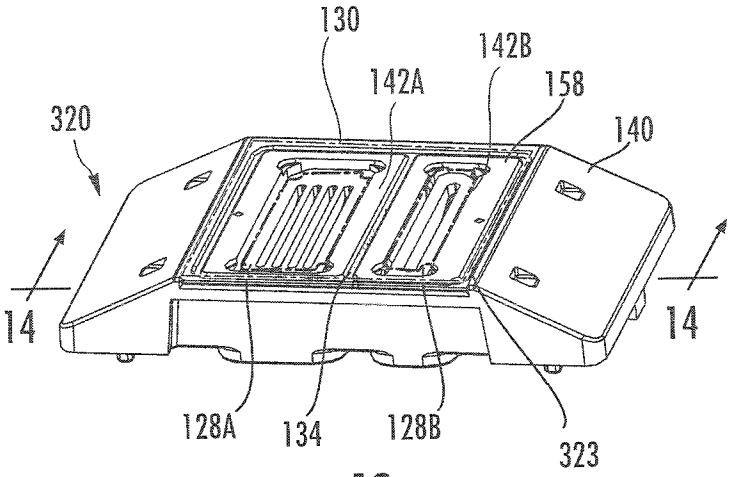
FIG. 13 is a top perspective view of another embodiment of the printing device of FIG. 3 according to an example embodiment.
Figure 14:
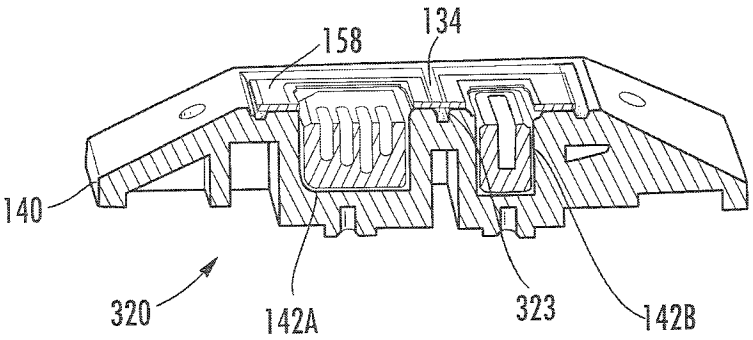
FIG. 14 is a sectional view of the printing device of FIG. 13 taken along line 14-14 according to an example embodiment.
Figure 15:
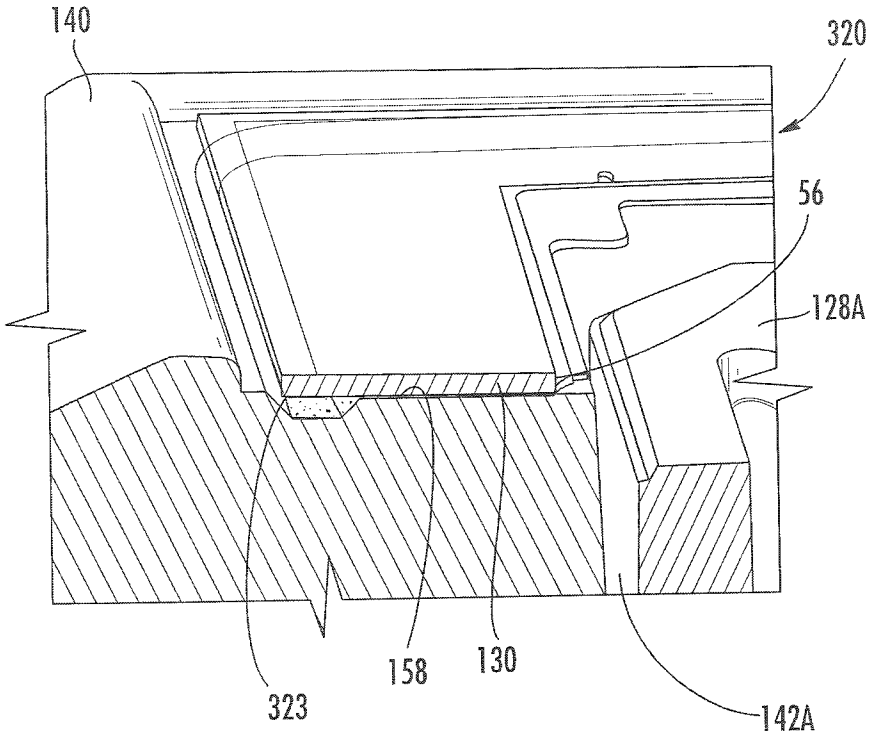
FIG. 15 is an enlarged view of a portion of the printing device of FIG. 14 according to an example embodiment.

FIGS. 13-15 illustrate printing device 320, another embodiment of printing devices 20 and 120. Printing device 320 is similar to printing device 120 with pattern 175 of solidified adhesive paste layer 134 except that surface 158 of body 140 of fluid delivery system 126 includes a depression, groove, channel or trench 323 extending into surface 158. As shown by FIG. 13, trench 323 has the same pattern as that of solidified adhesive paste layer 134. In the example illustrated, trench 323 continuously extends about print heads 128 and between print heads 128. In other embodiments wherein layer 134 has other patterns, such as those shown in FIGS. 4-12, trench 323 may also have corresponding patterns.

As shown by FIGS. 14 and 15, trench 323 receives solidified adhesive paste layer 134. Trench 323 limits or contains extent to which the adhesive paste material of layer 134 may migrate prior to partial or complete solidification. Trench 323 further provides flexible circuit 130 with a greater degree of flatness or levelness. In particular, the material of adhesive paste layer 134 (prior to solidification) is directly deposited into trench 323 to a height at, just above or proximate to surface 158 so as to contact and seal against flexible circuit 130. As a result, trench 323 enables a greater volume of the adhesive paste material layer 34 to be applied without a corresponding unevenness of flexible circuit 130 being created. Flexible circuit 130 may have a greater degree of parallelism with surface 158. As a result, trench 323 may enhance subsequent sealing against flexible circuit 130 during priming and may permit printing device 320 to be positioned closer to media during printing.

According to one example embodiment, trench 323 has a width of between about 0.25 mm and about 2 mm (nominally about 0.5 mm) and a depth of between about 0.1 mm and about 2 mm (nominally about 0.25 mm). In other embodiments, trench 323 may have other widths or depths depending upon the desired amount of adhesive paste material that is to be used to form layer 134.

Figure 18:
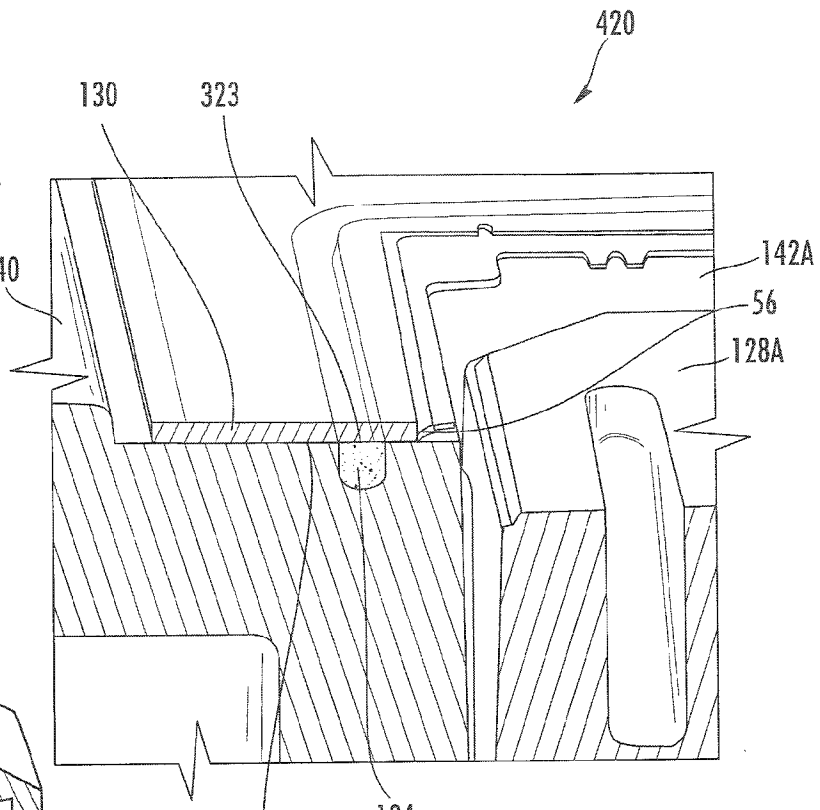
FIG. 18 is an enlarged view of a portion of the printing device of FIG. 17 according to an example embodiment.
Figure 16:
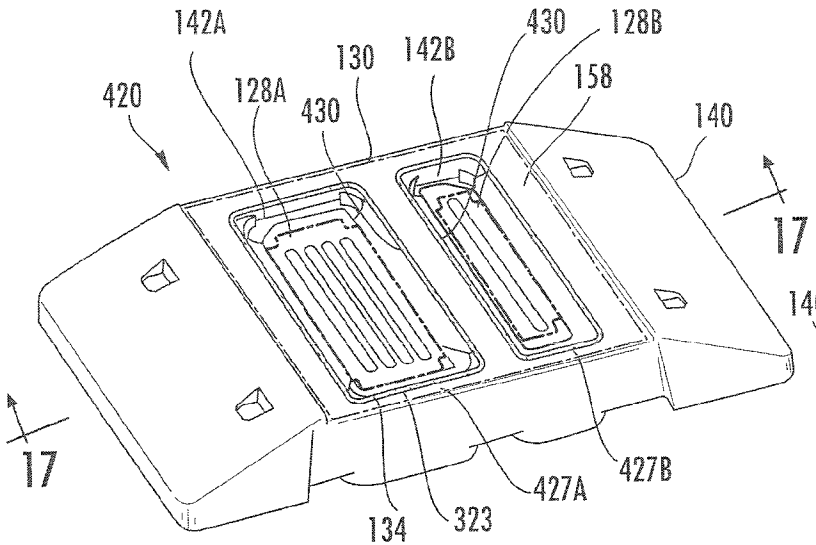
FIG. 16 is a top perspective view of another embodiment of the printing device of FIG. 3 according to an example embodiment.
Figure 17:
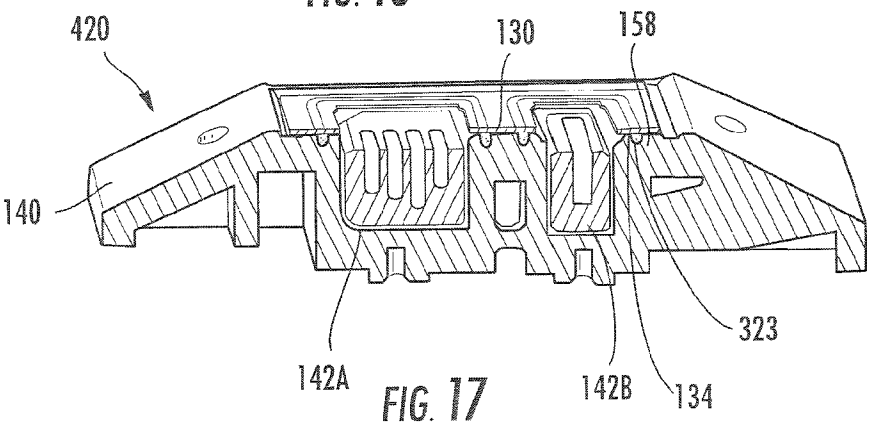
FIG. 17 is a sectional view of the printing device of FIG. 16 taken along line 17-17 according to an example embodiment.

FIG. 16-18 illustrate printing device 420 another embodiment of printing devices 20 and 120. Printing device 420 is similar to printing device 320 except that solidified adhesive paste layer 134 and trenches 323 each have pattern 205 as shown and described above with respect to FIG. 5. As shown by FIG. 16, trenches 323 comprise two distinct loops 427A and 427B (collectively referred to as loops 427). Loop 327A continuously extends about print head 128A. Loop 427 continuously extends about print head 128B. As before, trenches 323 directly receive adhesive paste material of layer 134. Trenches 323 serve to contain the adhesive paste material as it cures or solidifies. As noted above, trench 323 further enhances flatness of flexible circuit 130. Because trenches 323 and layer 134 form two independent isolation walls 430 between print heads 128, enhanced isolation of print heads 128 is provided which may reduce cross-contamination during priming.

Figure 21:
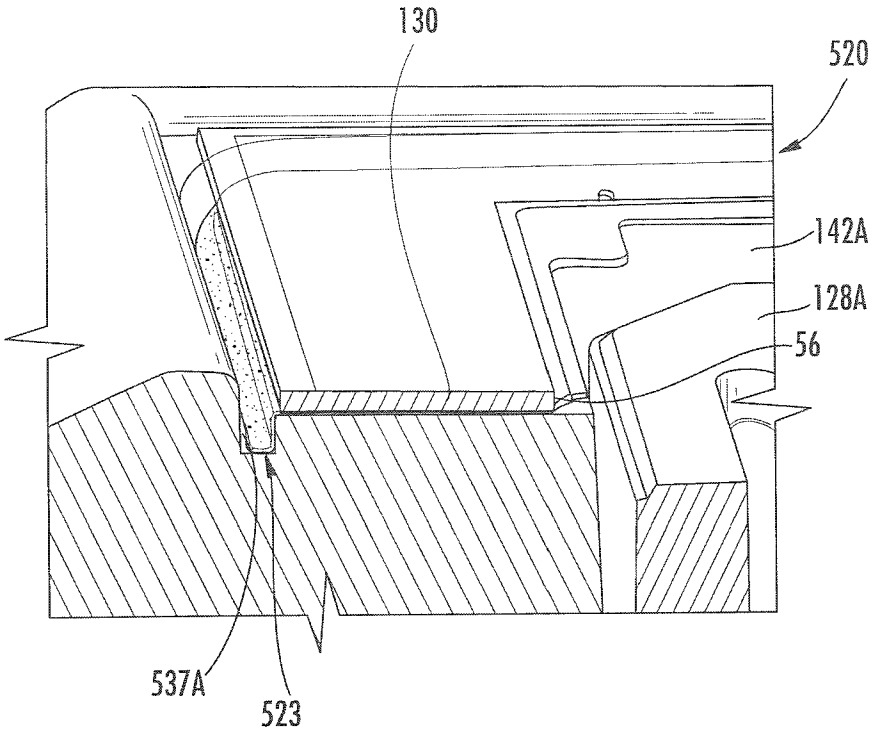
FIG. 21 is an enlarged view of a portion of the printing device of FIG. 20 according to an example embodiment.
Figure 19:
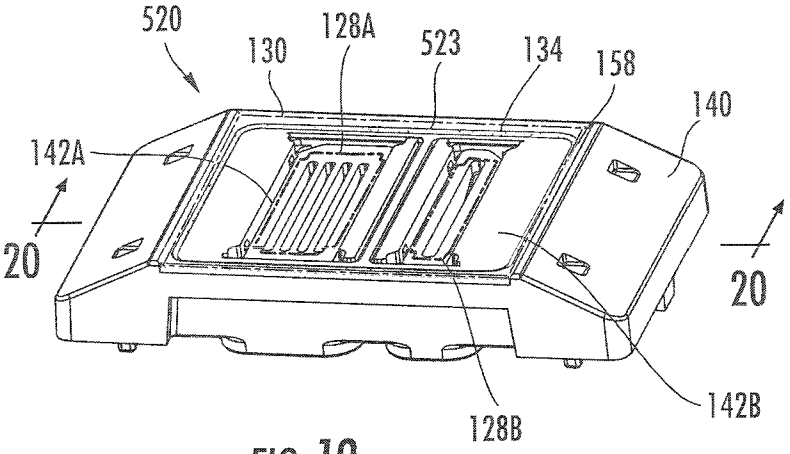
FIG. 19 is a top perspective view of another embodiment of the printing device of FIG. 3 according to an example embodiment.
Figure 20:
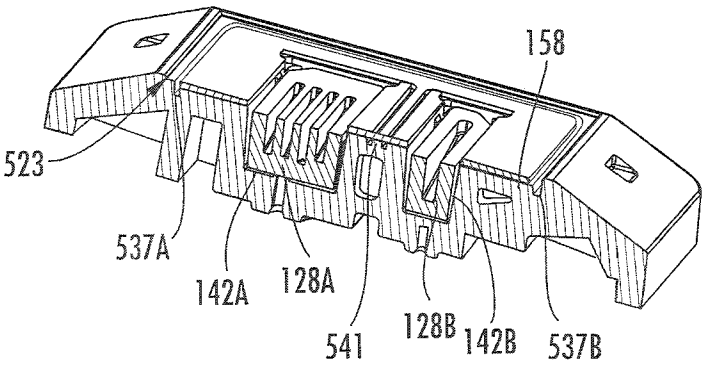
FIG. 20 is a sectional view of the printing device of FIG. 19 taken along line 20-20 according to an example embodiment.

FIGS. 19-21 illustrate printing device 520, another embodiment of printing devices 20 and 120. Printing device 520 is similar to printing device 320 with solidified adhesive paste layer 134 having pattern 175 except that printing device 520 additionally includes impressions, grooves, channels or trenches 523. Trenches 523 extend into surface 158 on one or both sides of layer 134. Trenches 523 serve as overflow channels or gutters by receiving excess adhesive paste material of layer 134 as flexible circuit 130 and surface 158 are being pressed against one another prior to curing or solidification of the adhesive paste material of layer 134. In such an embodiment, the material of adhesive paste layer 134 (prior to solidification) is deposited directly upon surface 158 near trenches 523. Excess material of layer 134 is squeezed into trenches 523. As a result, trenches 523 serve to contain the extent to which the adhesive paste material may migrate along surface 158 prior to solidification. Trenches 523 further receive excess adhesive paste material, reducing unevenness of flexible circuit 130 and enhancing the degree of flatness of flexible circuit 130 to potentially improve the ability of priming device 22 (shown in FIG. 1) to form a seal against flexible circuit 130.

In the example illustrated, trenches 532 form two distinct loops 537A and 537B (collectively referred to as loops 537). Those portions of loops 537 between print heads 128 form an intermediate plateau, rib or landing 541. In the example illustrated, the portion of layer 134 extending between print heads 128 is a largely centered on landing 541. As a result, layer 134 between print heads 128 is contained in both directions by trenches 523. Thus, layer 134 may be provided in closer proximity to one or both print heads 128 with a reduced likelihood of layer 134 interfering with or affecting the performance of print heads 128. This allows print is 128 to also be positioned closer to one another for a more compact design. At the same time, layer 134 continues to provide enhanced isolation between print heads 128 to reduce the likelihood of cross-contamination during priming.

As further shown by FIGS. 20 and 21, those portions of loops 537 of trenches 523 not between print heads 128 (the outboard portions of loops 537) extend on one side of layer 134 to the outside of layer 134. As a result, layer 134 may be provided distant from pockets 142 and print heads 128 closer to an outer edge of flexible circuit 130 with a reduced likelihood of the adhesive paste material of layer 134 migrating or being squeezed too far to the outside. Since layer 134 is distant pockets 142 and print heads 128, any inward migration of the adhesive paste material of layer 34 has little if any harmful results.

In the particular embodiment illustrated, trenches 523 have a width of between about 0.25 mm and about 2 mm (nominally about 0.5 mm) and a depth of between about 0.25 mm and about 2 mm (nominally about 0.5 mm). In other embodiments, trenches 523 may have other widths or depths depending upon the anticipated extent overflow of adhesive paste material of layer 134 and available area of surface 158. Moreover, in some embodiments, selected portions of trenches 523 may have varying dimensions. For example, portions of trenches 523 between print heads 128 may have a reduced width and increased depth as compared to other portions of trenches 523 not between print heads 128, permitting print heads 128 to be closer to one another.

In other embodiments, trenches 523 may have other patterns and configurations. In other embodiments where solidified adhesive paste layer 134 extends in close proximity to pockets 142 and print heads 128, trenches 523 may alternatively extend on the inside edge of layer 134 between layer 134 and moats 143 so as to prevent inward migration of the adhesive paste material of layer 134, prior to solidification or curing, towards print heads 128. Although trenches 523 are illustrated as being continuous, in other embodiments, trenches 523 may be intermittently located along one or both edges of layer 134 while still providing some degree of containment for the adhesive paste material of layer 134.

Figure 24:
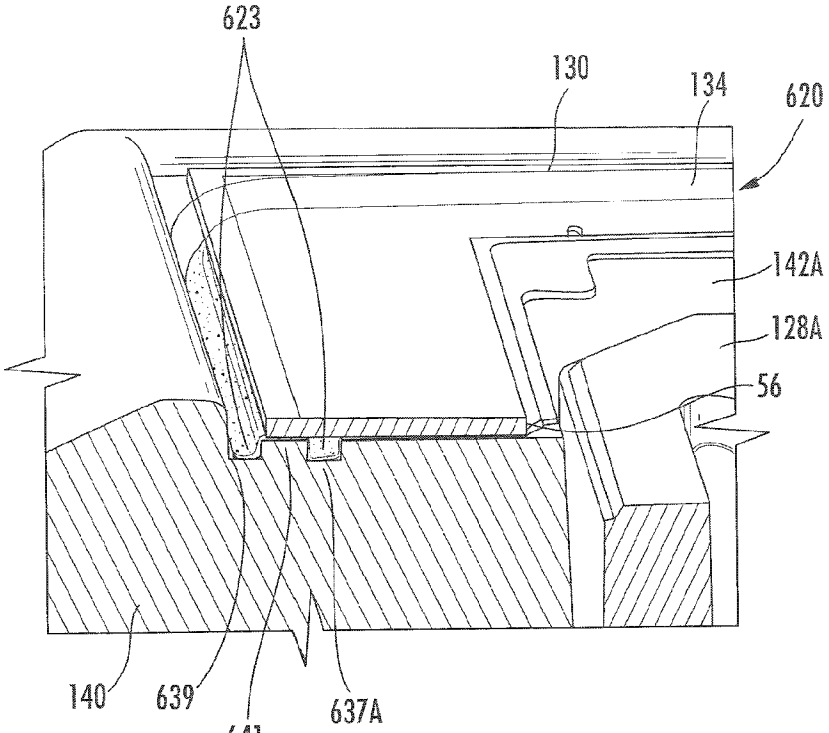
FIG. 24 is an enlarged view of a portion of the printing device of FIG. 22 according to an example embodiment.
Figure 22:
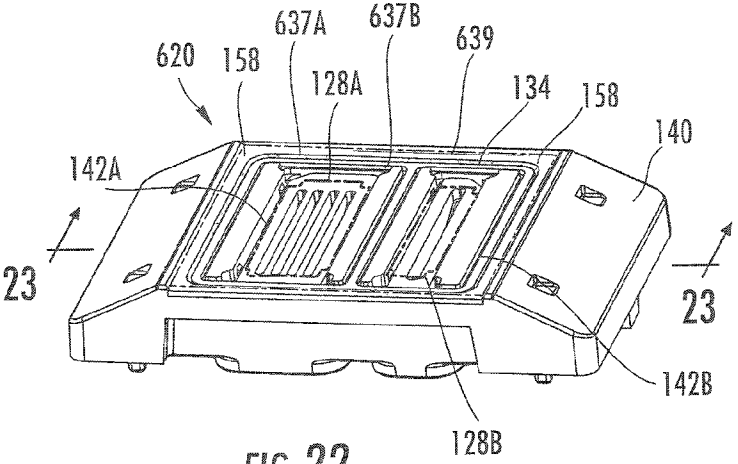
FIG. 22 is a top perspective view of another embodiment of the printing device of FIG. 3 according to an example embodiment.
Figure 23:
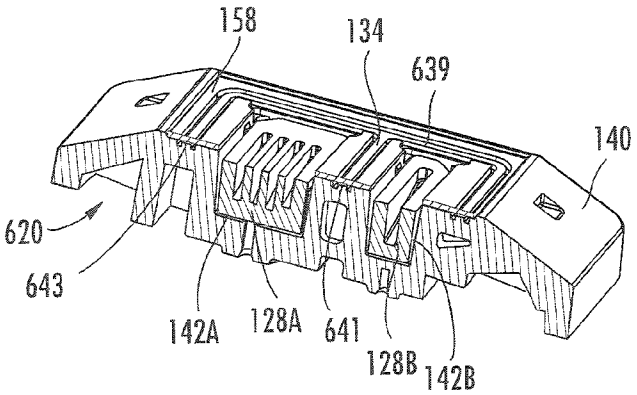
FIG. 23 is a sectional view of the printing device of FIG. 22 taken along line 22-22 according to an example embodiment.

FIGS. 22-24 illustrate printing device 620, another embodiment of printing devices 20 and 120. Printing device 620 is similar to printing device 320 with solidified adhesive paste layer 134 having pattern 175 except that printing device 520 additionally includes impressions, grooves, channels or trenches 623. Trenches 623 extend into surface 158 on both sides of layer 134. Trenches 623 receive excess adhesive paste material of layer 134 as flexible circuit 130 and surface 158 are being pressed against one another prior to curing or solidification of the adhesive paste material of layer 134. As a result, trenches 623 serve to contain the extent to which the adhesive paste material may migrate along surface 158 prior to solidification. Trenches 623 further receive excess adhesive paste material, reducing unevenness of flexible circuit 130 and enhancing the degree of flatness of flexible circuit 130 to potentially improve the ability of priming device 22 (shown in FIG. 1) to form a seal against flexible circuit 130.

In the example illustrated, trenches 623 form two distinct interior loops 637A and 637B (collectively referred to as loops 637) extending about print heads 128A and 128B, respectively. Trenches 623 further include a continuous outer loop 639 that extends alongside and substantially parallel to a collective outer perimeter of loops 637. Intermediate loops 637 are spaced from one another between print heads 128 to form an intermediate plateau, rib or landing 641. Outer loop 639 is spaced from inner loops 637 to form an intermediate plateau, rib or landing 643. In the embodiment illustrated, layer 134 is largely centered on landings 641 and 643. As a result, layer 134 between print heads 128 is contained in both directions by trenches 623. Thus, layer 134 may be provided in closer proximity to one or both print heads 128 between print heads 128 with a reduced likelihood of layer 134 interfering with or affecting the performance of print heads 128. This allows print heads 128 to also be positioned closer to one another for a more compact design. At the same time, layer 134 continues to provide enhanced isolation between print heads 128 to reduce the likelihood of cross-contamination during priming. In addition, layer 134 may also be located closer to an outboard edge of flexible circuit 130 for enhanced sealing.

In the particular embodiment illustrated, trenches 623 of loops 637 have a width of between about 0.25 mm and about 2 mm (nominally about 0.5 mm) and a depth of between about 0.25 mm and about 2 mm (nominally about 0.5 mm). Trench 623 of loop 639 has a width of between about 0.25 mm and about 2 mm (nominally about 0.5 mm) and a depth of between about 0.25 mm and about 2 mm (nominally about 0.5 mm). In other embodiments, trenches 623 may have other widths or depths depending upon the anticipated extent overflow of adhesive paste material of layer numeral 134 and available area of surface 158. Moreover, in some embodiments, selected portions of trenches 623 may have varying dimensions. For example, portions of trenches 623 between print heads 128 may have a reduced width and increased depth as compared to other portions of trenches 623 not between print heads 128, permitting print heads 128 to be closer to one another.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a fluid delivery system;

a first print head coupled to the fluid delivery system having nozzle openings and fluid passages leading to the nozzle openings;

a flexible circuit electrically connected to the first print head;

and a solidified adhesive paste layer sandwiched between the flexible circuit and the fluid delivery system, the nozzle openings of the first printhead extending on a first side of the solidified adhesive paste layer, and the flexible circuit extending on a second side of the solidified adhesive paste layer opposite the first side, wherein the solidified adhesive paste layer forms a hermetic seal between the flexible circuit and the fluid delivery system completely about and completely surrounding a perimeter of the first print head.

2. The apparatus of claim 1 further comprising a second print head, wherein the solidified adhesive paste layer forms a hermetic seal between the flexible circuit and the fluid delivery system at least partially about a perimeter of the second print head.

3. The apparatus of claim 2 further comprising a first trench extending into the fluid delivery system adjacent the solidified adhesive paste layer, wherein the solidified adhesive paste layer extends in at least portions of the trench.

4. The apparatus of claim 3, wherein the first trench extends between the first print head and the second print head.

5. The apparatus of claim 4 further comprising:

a second trench parallel to the first trench and between the first print head and the second print head; and a landing between the first trench and the second trench, wherein the solidified adhesive paste layer extends on the landing.

6. The apparatus of claim 5, wherein the first trench extends below and along an edge of the solidified adhesive paste layer.

7. The apparatus of claim 3 further comprising:

a second trench parallel to the first trench and between the first print head and the second print head; and a landing between the first trench and the second trench, wherein the solidified adhesive paste layer extends on the landing.

8. The apparatus of claim 7, wherein the first trench and the second trench extend about both the first print head and the second print head.

9. The apparatus of claim 2, wherein the solidified adhesive paste layer continuously extends entirely about the first print head and the second print head.

10. The apparatus of claim 2, wherein the solidified adhesive paste layer continuously extends between the first print head and the second print head.

11. The apparatus of claim 2, wherein the solidified adhesive paste layer includes:

a first loop continuously extending about the first print head; and a second independent loop continuously extending about the second print head.

12. The apparatus of claim 2, wherein the solidified adhesive paste layer includes:

a loop continuously extending about both the first print head and the second print head; and a segment continuously extending from a first side of the loop to a second opposite side of the loop between the first print head and the second print head.

13. The apparatus of claim 2, wherein the fluid delivery system includes a first pocket receiving the first print head and a second pocket receiving the second print head and wherein the apparatus further comprises a trench extending into the fluid delivery system adjacent the solidified adhesive paste layer and spaced from the first pocket and the second pocket.

14. The apparatus of claim 1, wherein the fluid delivery system includes a pocket receiving the first print head, wherein the apparatus further comprises a trench extending into the fluid delivery system adjacent the solidified adhesive paste layer and spaced from the pocket.

15. The apparatus of claim 1, wherein the adhesive paste layer is spaced from the first print head.

16. The apparatus of claim 15, wherein the fluid delivery system includes a pocket receiving the first print head and wherein the adhesive paste layer is spaced from the pocket.

17. A method comprising:

providing a print head having nozzle openings and fluid passages leading to the nozzle openings;

coupling the print head to a fluid delivery system;

providing a flexible circuit electrically connected to the to the first print head;

forming a layer of adhesive paste on one of the flexible circuit and the fluid delivery system; and positioning the layer of adhesive paste against the other of the flexible circuit and the fluid delivery system to sandwich said layer of adhesive paste, such that the nozzle openings of the printhead extending on a first side of the solidified adhesive paste layer, and the flexible circuit extending on a second side of the solidified adhesive paste layer opposite the first side, the layer of adhesive paste extending completely about and completely surrounding a perimeter of the print head and spaced from the print head.

18. The method of claim 17, wherein the layer of adhesive paste is formed by treating a pre-form from a non-paste state to a paste state.

19. The method of claim 17, wherein the layer of adhesive paste is formed by ejecting a bead of viscous adhesive paste on one of the flexible circuit and the fluid delivery system.

20. The method of claim 17, wherein the layer of adhesive paste has a viscosity of less than or equal to about 200,000 centipoise during the forming of the layer on one of the flexible circuit and the fluid delivery system.

21. The method of claim 17, wherein the fluid delivery system includes a trench spaced from the print head and wherein positioning the layer of adhesive paste against the other of the flexible circuit in the fluid delivery system squeezes some of the adhesive paste into the trench.

22. The method of claim 17, wherein coupling the print head to the fluid delivery system comprises positioning the print head within a pocket and wherein the formed layer of adhesive paste is spaced from the pocket.

23. An apparatus comprising:

a fluid delivery system;

a first print head coupled to the fluid delivery system having fluid passages leading to nozzle openings;

a flexible circuit electrically connected to the first print head; and a solidified adhesive paste layer sandwiched between the flexible circuit and the fluid delivery system, wherein the layer forms a hermetic seal between the flexible circuit and the fluid delivery system at least partially about a perimeter of the first print head;

a second print head, wherein the solidified adhesive paste layer forms a hermetic seal between the flexible circuit and the fluid delivery system at least partially about a perimeter of the second print head; and a first trench extending into the fluid delivery system adjacent the solidified adhesive paste layer, wherein the solidified adhesive paste layer extends in at least portions of the trench.

24. The apparatus of claim 23, wherein the first trench extends between the first print head and the second print head.

25. The apparatus of claim 24 further comprising:

a second trench parallel to the first trench and between the first print head and the second print head; and a landing between a first trench and the second trench, wherein the solidified adhesive paste layer extends on the landing.

* * * * *

UNITED STATES PATENT AND TRADEMARK OFFICE

CERTIFICATE OF CORRECTION

PATENT NO. : 9,056,470 B2
APPLICATION NO. : 12/935023
DATED : June 16, 2015
INVENTOR(S) : Michael M. Marrow et al.

It is certified that error appears in the above-identified patent and that said Letters Patent is hereby corrected as shown below:

Claims

In column 12, lines 20-21, in Claim 17, delete "to the to the" and insert -- to the --, therefor.

Signed and Sealed this
Twenty-first Day of June, 2016

Michelle K. Lee

Michelle K. Lee
*Director of the United States Patent and Trademark Office*